United States Patent [19]

Rinkewich

[11] 4,432,591

[45] Feb. 21, 1984

[54] STORAGE AND TRANSPORT CART WITH IMPROVED SECURITY

[75] Inventor: Isaac Rinkewich, Tel-Aviv, Israel

[73] Assignee: M.I.T. Poly-Cart Corp., New York, N.Y.

[21] Appl. No.: 257,703

[22] Filed: Apr. 27, 1981

[51] Int. Cl.[3] ..... E06B 9/14

[52] U.S. Cl. ..... 312/297; 312/138 R; 312/209; 160/232; 160/235

[58] Field of Search ..... 312/297, 209, 138 R; 160/235, 201, 232, 220

[56] References Cited

U.S. PATENT DOCUMENTS

| | | | |
|---|---|---|---|
| 769,423 | 9/1904 | Wilson | 160/235 |
| 1,918,415 | 7/1933 | Miller | 160/235 |
| 2,202,358 | 5/1940 | Stone | 312/297 |
| 2,231,005 | 2/1941 | Gordon | 160/201 |
| 2,767,787 | 10/1956 | Miller | 160/201 |
| 2,872,977 | 2/1959 | Pagliaccetti et al. | 160/235 |
| 3,148,724 | 9/1964 | Chieger et al. | 160/201 |
| 3,251,636 | 5/1966 | Hein | 312/297 |
| 3,330,611 | 7/1967 | Heifetz | 312/297 |
| 3,489,200 | 1/1970 | Recchione | 160/235 |
| 3,842,891 | 10/1974 | Kinnroth et al. | 160/220 |
| 4,171,150 | 10/1979 | Soderlund | 312/297 |
| 4,343,340 | 8/1982 | Paule | 160/232 |

FOREIGN PATENT DOCUMENTS

| | | | |
|---|---|---|---|
| 1128688 | 8/1956 | France | 160/235 |
| 1282133 | 12/1960 | France | 160/235 |
| 1421525 | 11/1965 | France | 160/236 |
| 1427143 | 12/1965 | France | 160/235 |
| 1530680 | 5/1967 | France | 160/235 |
| 1336773 | 11/1973 | United Kingdom | 312/297 |

*Primary Examiner*—Victor N. Sakran

*Attorney, Agent, or Firm*—James & Franklin

[57] ABSTRACT

The cart includes a body having a front wall with an opening. Tracks for a plastic shutter-type door are located at either side of the opening. The end portions of the articulately interconnected members making up the door are received within the tracks. Each end portion has a protruding lip. Each track includes a pair of spaced members, one of which carries a lip which extends towards the surface of the end portion. The end portion of the door is received between the track members with the lip on the track member situated between the lip on the end portion and the wall opening. The lips interengage to prevent removal of the door from the track. A rigid insert is received within a slot extending along the length of each door member so as to reinforce same.

8 Claims, 3 Drawing Figures

STORAGE AND TRANSPORT CART WITH IMPROVED SECURITY

The present invention relates to storage and transport carts and, more particularly, to a cart with enhanced security to reduce the possibility of pilferage of items stored and/or transported in the cart.

Storage and transport carts are used for a wide variety of different applications. Hospitals use such carts to store and transport medicine, linen and other supplies which must be kept sanitary and secure. Restaurants and cafeterias and the like use carts to transfer food products and protect same against dust and other environmental contamination. Department stores use carts to transport garments and other merchandise and secure same against pilferage. Similarly, hotels, motels and laundries use carts to collect and distribute linens.

Carts designed to perform the above-mentioned tasks normally comprise a molded polymer box-like or wedge-shaped body which is mounted on wheels or casters to provide mobility. The interior of the cart body may be empty for bulk storage or may be provided with one or more horizontal shelves upon which merchandise can be stored. The body may be open—having a non-coverable side or top, or both. Alternatively, the body may be enclosed with a wall having an opening covered by one or more doors which open outwardly to provide access to the interior of the enclosure. For security purposes, the doors may be locked to protect the items within the enclosure from pilferage.

In one type of cart, the outwardly opening doors are replaced by a single shutter-type door which slides on tracks located at either side of the opening. Such a door is normally composed of a plurality of horizontally extending members which are articulately interconnected so as to be pivotable, to a limited extent, with respect to each other. Such a shutter-type door has an advantage over the outwardly swinging doors. It is entirely contained within the enclosure when open. Thus, no additional space around the enclosure need be provided to permit the opening of the door.

From a commercial viewpoint, it is necessary that the cart be as light in weight and inexpensive as possible. The weight of the cart is important because the lighter the weight, the higher degree of mobility. In order to keep the weight to a minimum, it is desirable that the door be made of light weight material. The light weight door also facilitates the opening thereof, which requires lifting of same.

In order to achieve these ends, the cart body and the door are preferably made of molded plastic. The cart body is, thus, washable and sanitary. It has no seams, crevices or joints to catch dirt or snag contents. No nails or screws are required and there are no parts to rust. The door is composed of a plurality of individual molded hollow plastic members which are articulately interconnected to provide a shutter-type flexible, light weight and easily movable structure. The shutter-type door is designed to be situated within the body, when open.

However, for certain applications, one of the main functions of certain carts is to provide a secure environment to prevent pilferage of the items stored within the cart. Unfortunately, conventional flexible plastic doors, preferable because of weight and cost considerations, do not provide sufficient security for the cart.

In particular, a shutter-type door composed of relatively flexible, hollow plastic, articulately interconnected members poses a security problem because it is relatively easy to remove the door from the tracks, when the door is closed. This is done by applying a force at the center of the door so as to cause the door members to flex to a sufficient extent that the end portions thereof can be popped out of the track. Thus, even if the door is closed and locked, one intent on removing the articles stored within the cart may do so with relative ease.

It is, therefore, a prime object of the present invention to provide a storage and transport cart with enhanced security wherein the door is mounted to the tracks in a manner which prevents the removal thereof.

It is another object of the present invention to provide a storage and transport cart with enhanced security wherein the end portions of the door and the tracks are provided with interengaging means, structured to prevent the removal of the door from the tracks.

It is another object of the present invention to provide a storage and transport cart with enhanced security wherein the plastic members which make up the shutter door are provided with a rigid insert, inserted into a slot which extends along the length thereof, so as to reinforce same.

In accordance with the first aspect of the present invention, the storage and transport cart comprises a body having a wall with an opening. Tracks are located at either side of the opening. A door is provided having end portions situated within the tracks. The door is movable between an open position, wherein access to the interior of the body is provided, and a closed position, wherein access to the interior of the body is prevented. Each door end portion has a lip extending from the surface thereof. Each track comprises first and second spaced members. The first member has a lip thereon extending toward the surface of the door end portion. The door end portion is adapted to be received between the track members, with the lip on the first member situated between the lip on the door end portion surface and the opening. Interengagement between the lips prevents removal of the door from the track.

The second track member is integral with the wall of the body and comprises a first part, extending in a substantially perpendicular direction from the wall, and the second part, extending from the first part in a direction substantially parallel to the wall. The first member is connected to the second member and extends in a direction spaced from and substantially parallel to the second part of the second member.

In accordance with a second aspect of the present invention, the door comprises a plurality of hollow, substantially flexible members. Means are provided for articulately interconnecting the members. Each of the door members has an interior slot which extends along the length thereof. A substantially rigid insert is received within the slot. In this manner, the door members are structurally reinforced.

To these and such other objects which may hereinafter appear, the present invention relates to a storage and transport cart with increased security, as described in the following specification and recited in the annexed claims, taken together with the accompanying drawings, wherein like numerals refer to like parts, and in which:

Figure 1:
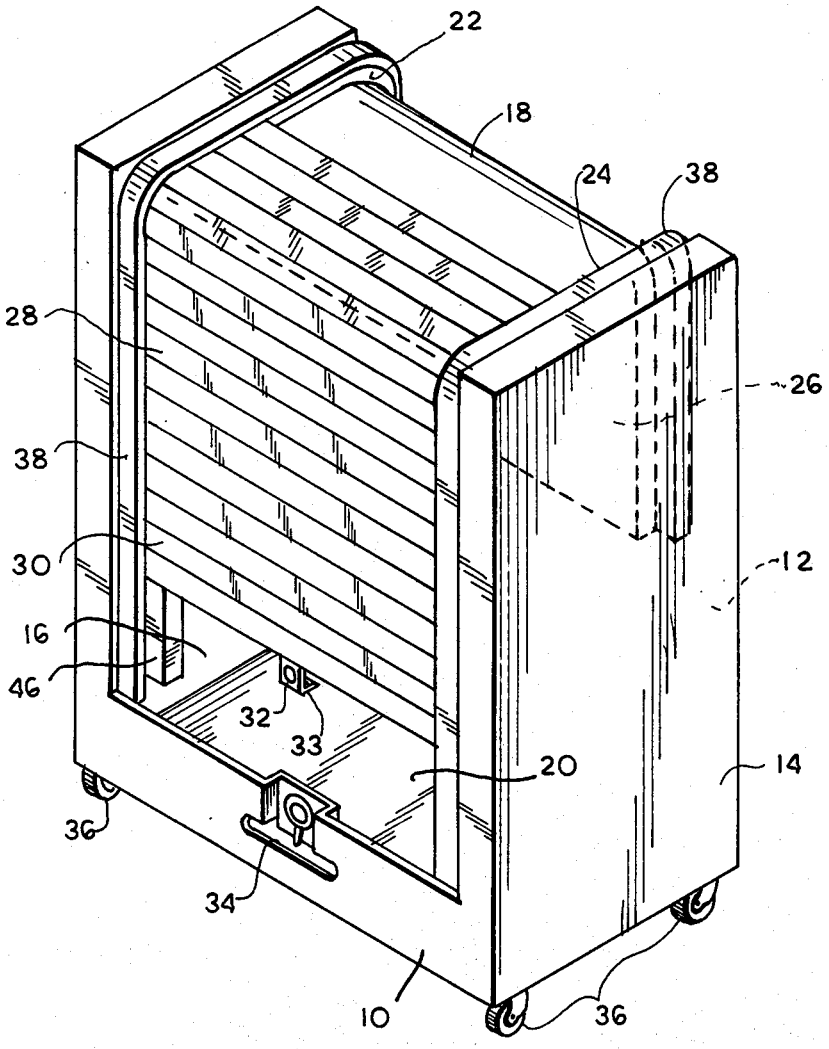
FIG. 1 is an isometric view of the storage and transport cart with improved security of the present invention.

As seen in FIG. 1, the cart of the present invention comprises a substantially box-like body, formed of molded plastic or the like, comprising a front surface 10, a rear surface 12, side surfaces 14 and 16 and a top surface 18. Front surface 10 has an opening 20 therein which is defined between a pair of tracks 22, 24. Tracks 22, 24 extend over recessed top surface 18 and partially down rear surface 12. Rear surface 12 is provided with a recessed portion 26 which abuts recessed rear surface 18 such that when door 28 is in the closed position, surfaces 18 and 26 are exposed, but access to the interior of the body is prevented.

Door 28 is located between and within tracks 22 and 24, and is movable therealong so as to open and close opening 20 in front wall 10 to provide access to the interior of the cart body. Door 28 is of the shutter type and is formed of a plurality of individual, hollow plastic members 30 which are articulately interconnected in the manner described below.

A member 32, which acts as a handle to facilitate opening and closing of door 28, is provided with an inwardly extending lip 33, with an opening to receive a lock when inserted within an opening 34 in front wall 10, such that door 28 can be locked in the closed position. In this manner, items stored within the cart body can be protected from pilferage.

Mounted to the bottom of the cart are four wheels or casters 36. One of casters 36 is located at each corner of the cart. Casters 36 provide the cart body with the necessary mobility.

Since members 30 of door 28 are made of hollow plastic, there is a certain amount of flexing possible along the length thereof. In doors of this type, it is possible to exert a force at the middle of the door, causing sufficient curvature of the door members so that the end portions thereof can be made to pop out of the track. Thus, when the door is closed and locked, it can be removed from the tracks, thereby providing access to the interior of the cart body. In order to prevent this, the door and tracks are provided with interconnecting means which prevent the removal of the door from the track. In addition, the individual members 30 of the door are reinforced to reduce the amount of possible flexing.

Figure 2:
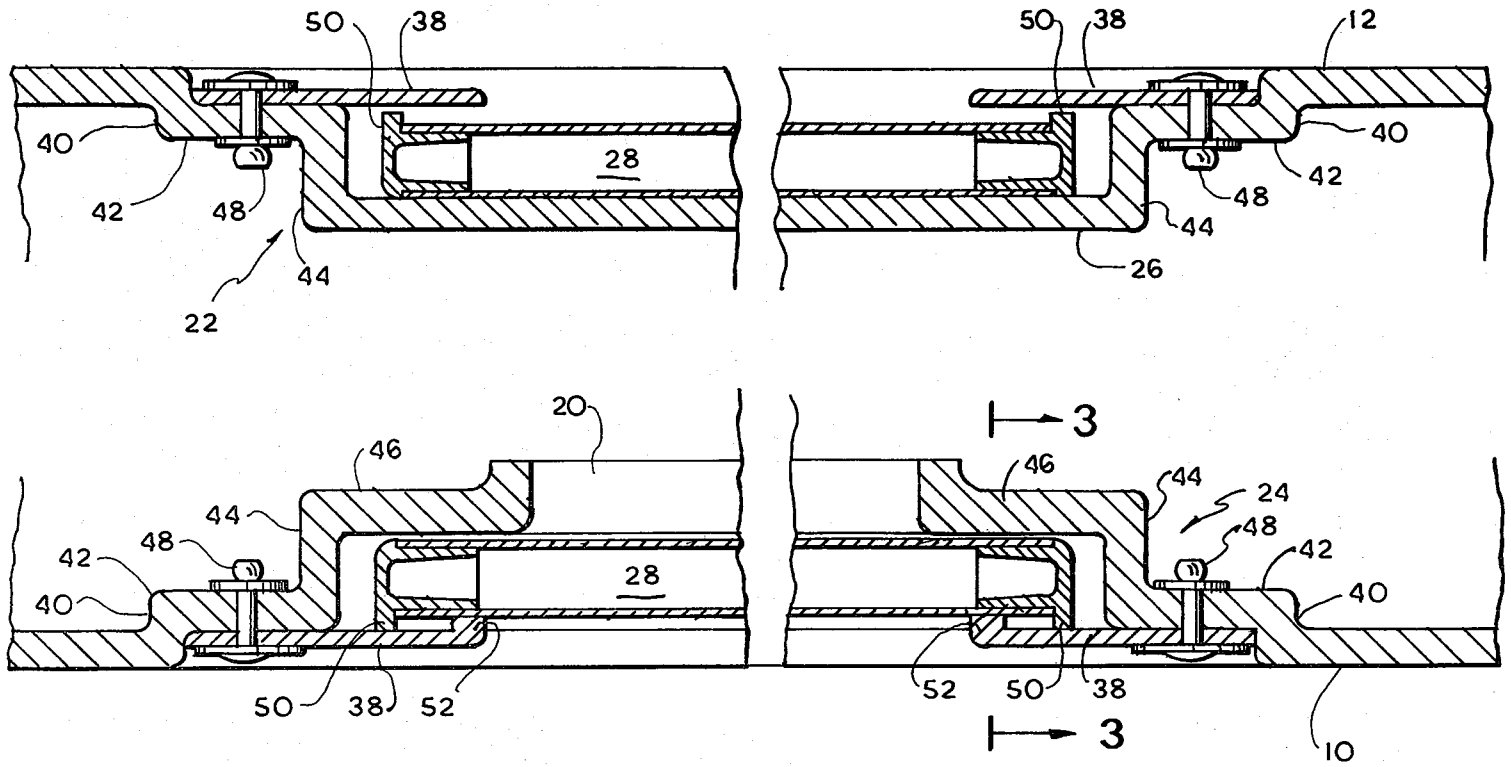
FIG. 2 is a top cross-sectional view of the cart body shown in FIG. 1.

FIG. 2 shows the front and rear tracks in cross-section. Each of the tracks comprises a first, substantially planar outer member 38, and a second, step-like member, the latter of which is integral with the adjacent wall. The second member comprises a first section 40, substantially perpendicular to, and extending from, the adjacent wall 10 (12), a second section 42, substantially parallel to the adjacent wall 10 (12) and extending from section 40, a third section 44, substantially perpendicular to the wall 10 (12) and extending from section 42, and a fourth section 46 (26) which is substantially parallel to the wall 10 (12) and extends from section 44. Section 46 (26) is parallel to, but spaced from, first part 38, such that the end portion of door 28 can be received therebetween. Section 42 is recessed from the exterior surface of the wall 10 (12) by a distance greater than the thickness of part 38, such that part 38, which is fastened to section 42 by means of a rivet 48 or the like, is also somewhat recessed from the surface 10 (12).

Each end portion of each member 30 of door 28 is provided with a lip 50 extending from the surface thereof. Lip 50 extends towards the interior surface of first part 38. The interior surface of the portion of part 38 which is adjacent the front wall 10 is provided with a lip 52 which extends towards the end portion of the door 28. Lip 52 is situated between opening 20 and lip 50 on the end portion of the door. If an attempt is made to remove door 28 from the tracks, lip 50 on the end portion of the door will interengage with lip 52 on part 38 and prevent the door from being slipped out of the tracks.

The portions of first part 38 adjacent the back 12 and top 18 surfaces are not provided with a lip 52 because door 28 does not cover the opening at the top or rear of the cart body when in the closed position. This function is provided by recessed top and rear surfaces 18 and 26.

Figure 3:
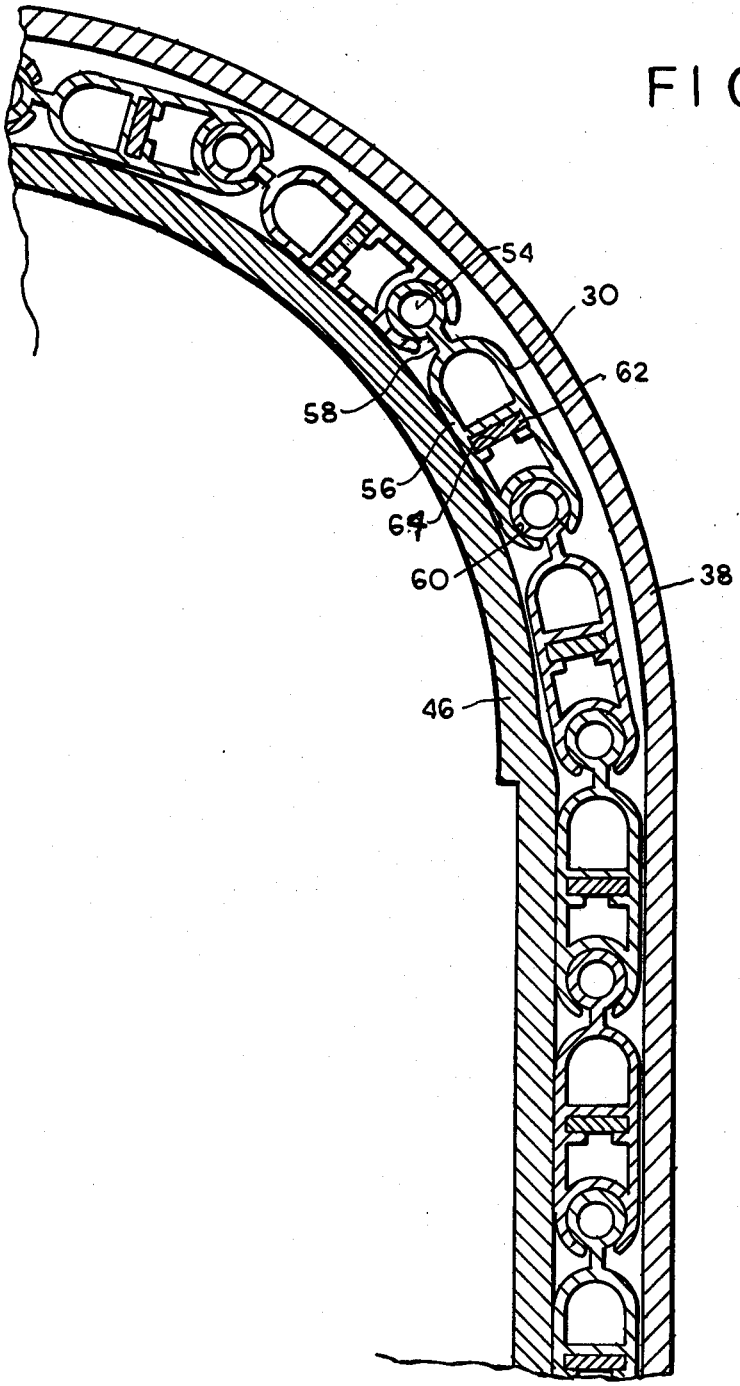
FIG. 3 is a side cross-sectional view of the door, taken along line 3—3 of FIG. 2.

The manner in which the individual members 30 are reinforced is illustrated in FIG. 3, which shows the members 30 in cross-section. Each member 30 has a top, substantially cylindrical, hollow part 54 connected to the elongated body part 56 by a neck 58. At the bottom of body part 56 is a substantially cylindrical cavity 60 which is adapted to receive, in a freely pivotal fashion, the cylindrical top part 54 of the adjacent member 30. Cylindrical part 54 and cavity 60 comprise the means for articulately interconnecting the members 30.

The body portion 56 of each member 30 has a central part 62 which extends across the hollow interior of member 30, along the entire length thereof. Each part 62 is provided with a slot into which a rigid insert 64, which extends along the entire length of the member 30, is received. Insert 64 serves to reinforce the member 30 by enhancing the structural rigidity thereof. In this manner, members 30 are made inexpensively of relatively flexible plastic material and, thereafter, reinforced by inserts 64 so as to achieve the necessary structural rigidity.

It will now be appreciated that the present invention relates to a storage and transport cart with improved security which is a result of providing interengaging means between the door and the tracks which cooperate to prevent the removal of the end portions of the doors from the tracks. The security of the device is further enhanced by structurally reinforcing the articulately interconnected members which form the shutter-type door, so as to reduce the possibility of flexing thereof. Both of these improvements result in a cart which has enhanced security, without substantially increasing the cost or weight thereof.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A storage and transport cart comprising a body having a wall with an opening, interior and exterior spaced parts defining a track along said opening, said exterior part being recessed relative to the exterior surface of said wall, a relatively flexible door having an end portion situated in and movable along said track between open and closed positions, and interengaging means on said track and said end portion cooperating to prevent removal of said end portion from said track when said door is flexed inwardly, said means comprising first and second lips, said first lip being situated along the edge of said exterior part and extending towards said interior part, said second lip situated along the edge of said end portion and extending towards said exterior part.

2. The cart of claim 1, wherein said interior part is integral with said wall.

3. The cart of claim 1, wherein said wall comprises a first portion recessed relative to the exterior surface of said wall and a second portion recessed relative to said first recessed portion.

4. The cart of claim 3, wherein said exterior part is mounted to the exterior of said first recessed portion.

5. The cart of claim 3, wherein said second recessed portion comprises said interior part.

6. The cart of claim 1, wherein said door comprises a plurality of members, each comprising a protruding connecting part, a first recess adapted to movably receive the protruding connecting part of an adjacent member, a rigidity enhancing insert, and a second recess adapted to receive said rigidity enhancing insert.

7. The cart of claim 6, wherein said insert has a generally rectangular cross-sectional shape and said second recess has a generally rectangular cross-sectional shape.

8. The cart of claim 6, wherein each of said members has a hollow portion and said second recess is defined between parts extending into the interior of said member from the wall of said hollow portion.

* * * * *